United States Patent [19]

Eckert

[11] 4,303,371

[45] Dec. 1, 1981

[54] SHROUD SUPPORT WITH IMPINGEMENT BAFFLE

[75] Inventor: Terry T. Eckert, Fairfield, Ohio

[73] Assignee: General Electric Company, Cincinnati, Ohio

[21] Appl. No.: 912,904

[22] Filed: Jun. 5, 1978

[51] Int. Cl.[3] ..... F01D 5/08

[52] U.S. Cl. ..... 415/116; 415/175; 415/178

[58] Field of Search ..... 415/115, 116, 175, 178

[56] References Cited

U.S. PATENT DOCUMENTS

| | | | |
|---|---|---|---|
| 3,628,880 | 12/1971 | Smuland et al. | 415/115 |
| 3,728,039 | 4/1973 | Plemmons et al. | 415/115 |
| 3,825,364 | 7/1974 | Halila et al. | 415/116 |
| 3,844,343 | 10/1974 | Burggraf | 415/116 |
| 3,975,901 | 8/1976 | Hallinger et al. | 415/115 |
| 4,017,207 | 4/1977 | Bell et al. | 415/115 |
| 4,050,843 | 9/1977 | Needham et al. | 415/116 |
| 4,053,254 | 10/1977 | Chaplin et al. | 415/116 |
| 4,126,405 | 11/1978 | Bobo et al. | 415/115 |

FOREIGN PATENT DOCUMENTS

| | | | |
|---|---|---|---|
| 1330892 | 9/1973 | United Kingdom | 415/116 |
| 1484288 | 9/1977 | United Kingdom | 415/116 |

*Primary Examiner*—Everette A. Powell, Jr.
*Attorney, Agent, or Firm*—Dana F. Bigelow; Carl L. Silverman; Derek P. Lawrence

[57] ABSTRACT

A continuous 360° impingement baffle is attached directly to a shroud support structure such that the combination provides a low-leakage, high pressure plenum for supplying impingement airflow to the turbine rotor shroud for cooling purposes. After impingement, the air is at a low-pressure and is free to feed the conventional leakage paths with little loss of system efficiency.

12 Claims, 3 Drawing Figures

SHROUD SUPPORT WITH IMPINGEMENT BAFFLE

The invention herein described was made in the course of or under a contract, or a subcontract thereunder, with the United States Department of the Air force.

BACKGROUND OF THE INVENTION

This invention pertains generally to gas turbine engines and, more particularly, to the support and cooling of the turbine rotor shroud portion thereof.

Gas turbine engines are made to operate more efficiently by increasing the turbine operating temperatures to very high levels. Since the preferred temperatures are well above the temperatures allowable for use with current flow path metals, it is necessary to provide cooling of these parts in order that they may exhibit acceptable life characteristics. The turbine blades, which operate in the main gas flow stream, are normally cooled by way of convection, impingement or film cooling, or a combination of the three forms. The shrouds, which surround the row of turbine blades forming a stationary outer flow path, are more commonly cooled by impinging a supply of cooling air, as, for example, bleed air from the compressor, to flow directly on the outer surface of the shroud element. Traditionally, impingement of air against the outer surface of the shroud is accomplished by way of an impingement baffle which is mounted to the outer surface of the shroud structure in such a way that the baffle, or the plurality of circumferential baffle segments, form a common boundary between the radially inward low pressure plenum where the impinged air resides, and the radially outer high pressure plenum which is defined in part by the shroud support and which receives the relatively high pressure air from the compressor bleed air manifold or the like. In some installations it has been estimated that the amount of leakage air in such a system is in the order of 40 percent of the total metered shroud cooling airflow. This leakage occurs in any one of a number of leakage paths. Because of the necessity to have a number of interfitting parts such as, for example, the shroud support grooves and the shroud flanges which fit into those grooves, there is a tendency for the high pressure cooling air to leak from the plenum without passing through the impingement baffle. Also, the shrouds are segmented so that the thermal response of the shroud assembly is controlled by the shroud support and, since the shrouds are sized in equal circumferential length such that thermal stress which produces segment straightening is held to a minimum during engine running, there is necessarily considerable leakage between the shroud segments. Higher pressures, of course, tend to increase the cooling effectiveness of the system, but on the other hand tend to also increase the leakage. There is a definite plenum pressure which will minimize the shroud metal temperature. Since the heat extracted from the shroud is a function of the impingement flow times the impingement air heat pickup (cooling effectiveness), there is a plenum pressure where the improved cooling effectiveness of higher plenum pressure is not sufficient to offset the reduction in impingement flow.

It is therefore an object of the present invention to provide an improved shroud support and cooling apparatus.

Another object of the present invention is to provide a shroud cooling apparatus with increased efficiency characteristics.

Yet another object of the present invention is the provision in a shroud cooling apparatus for reduction in high pressure air leakage.

Yet another object of the present invention is the provision in a shroud cooling apparatus for the use of higher pressure air with decreased amounts of leakage.

Still another object of the present invention is the provision in a shroud cooling apparatus for reducing the number of leakage paths from the high pressure side of the impingement baffle.

Yet another object of the present invention is the provision for a turbine shroud support and cooling apparatus which is economical to manufacture and efficient in use.

Another object of the present invention is the provision for a greater percentage of the metered flow to pass out into the flow path through film holes rather than as leakage.

These objects and other features and advantages become more readily apparent upon reference to the following description when taken in conjunction with the appended drawings.

SUMMARY OF THE INVENTION

Briefly, in accordance with one aspect of the invention, the impingement baffle is secured directly to the shroud support structure such that the combination provides a high pressure plenum which is relatively free of leakage paths. This high pressure air can then flow through the baffle to provide effective and efficient impingement cooling, and the impinged air, which is at a low pressure, can then either flow to areas which would otherwise have been high-leakage paths or exit through film holes without any significant loss in turbine efficiency.

In accordance with another aspect of the invention, the impingement baffle comprises a continuous ring which is fastened to the shroud support by way of an interference fit to provide a substantially leak-free high pressure plenum which provides impingement cooling in an efficient manner.

In accordance with yet another aspect of the invention, the impingement baffle is formed in a ring of U-shaped cross section wherein one leg engages one portion of the shroud support element and the other leg engages another portion thereof such that the impingement baffle forms at least a part of each of three sides of the high pressure plenum. Perforations are provided in the radially inner leg of the impingement baffle so that air may be made to impinge efficiently against the shroud. The radially outer leg of the baffle acts as a heat shield to isolate the cooler high pressure air from the relatively warm shroud support element.

In the drawings as hereinafter described, a preferred embodiment and a modified embodiment are depicted; however, various other modifications and alternate constructions can be made thereto without departing from the true spirit and scope of the invention.

DESCRIPTION OF THE PREFERRED EMBODIMENT

Figure 1:
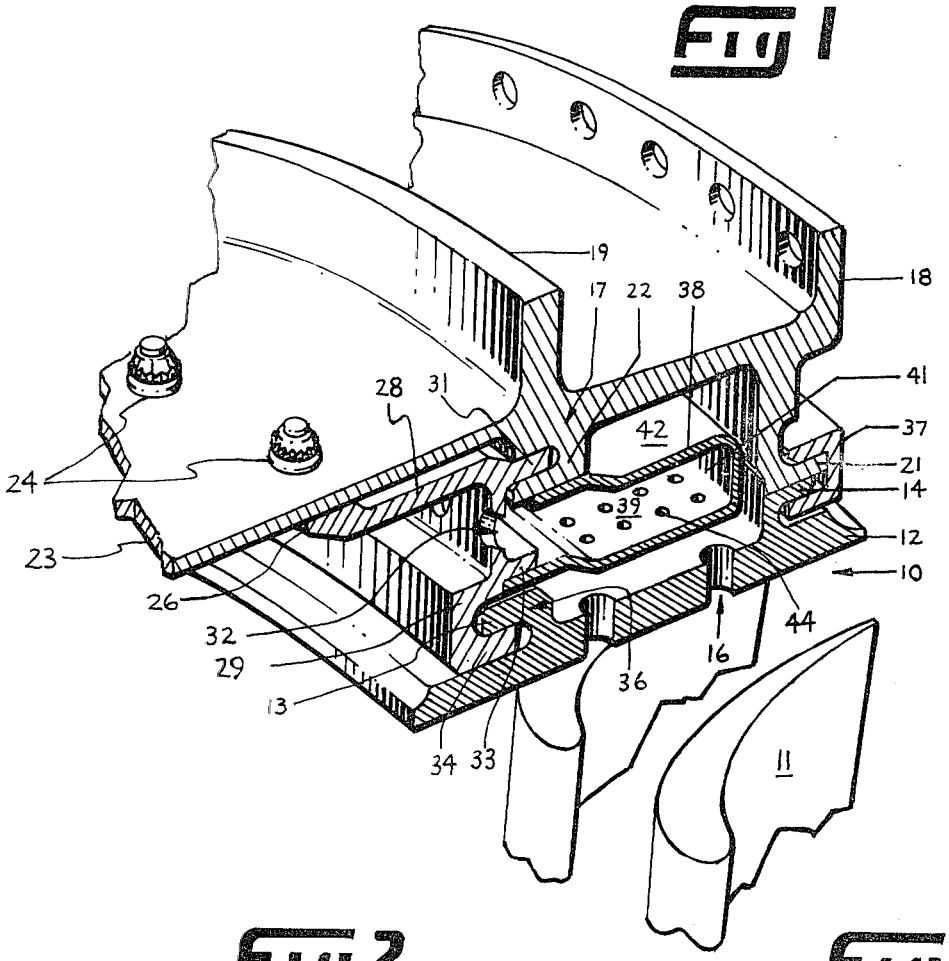
FIG. 1 is a perspective view of a shroud support structure in accordance with the preferred embodiment of the invention.

The invention is shown generally at 10 of FIG. 1 wherein a row of turbine blades 11, which are rotatably disposed in the main gas flow stream, are closely surrounded by a plurality of circumferentially spaced shroud segments 12 which form the outer flow path of the hot gases at that point. In accordance with standard design practices, the shroud 12 should be located as close to the turbine row as possible without making actual contact therewith. However, it is assumed that there may be periods in which the turbine row blade would rub on the shroud and, to allow for that situation, the radially inner side of the shroud segments may be comprised of an abradable material or, in the alternative, the tip of the blades may be made of an abrasive material.

The shroud segments 12 comprise flat annuluses which may be fabricated by way of casting or machining. Formed on the radially outer side are forwardly and rearwardly extending flanges 13 and 14 which provide a means of supporting and placing the shroud segments. Formed in the radially inner portion of the shroud segments 12 are a plurality of holes 16 which allow for the passage of low pressure air as will be more fully described hereinafter.

Disposed radially outside of the shroud 12 is a shroud support element 17 which is secured to a turbine casing (not shown) by way of a rear flange 18 and which is secured at its forward end by way of attachment to a combustor casing (not shown). In addition to the rear flange 18, there is a midflange 19 which is preferably of substantial mass such that the thermal inertia of the shroud support element 17 is increased. This feature is desirable for purposes of transient control of the shroud position by the use of selective cooling and heating of the shroud support in accordance with known principles.

The shroud support element 17 comprises a continuous ring having inward flanges 21 and 22 extending inwardly and rearwardly, and inwardly and forwardly, respectively. The flanges shrink and grow in accordance with variations in the temperature of the shroud support element 17 and, since they are the basis of support for the shroud 12, it is their position that determines the clearance between the shroud 12 and the rotor 11.

Attached to a forward cylindrical portion 23 of the shroud support element 17 by a plurality of bolts 24 is a support bracket 26 which is formed as individual circumferential segments having a horizontal portion 28 and a radial portion 29. The horizontal portion 28 has a rearward extension 31 which fits over and is supported by the inward flange 22 of the shroud support element 17. The radial portion 29 has a plurality of ports 32 formed therein for the conduct of cooling air in a manner to be described hereinafter. Also formed on the radial portion 29 are outer and inner rearward flanges 33 and 34 which, together, define a groove 36 for receiving the forward flange 13 of the shroud 12. The shroud 12 is then held in place at its forward end by the groove 36 of the support bracket 26 and, at its rear end by a U-clip 37 which extends over and holds together the rear flange 14 of the shroud 12 and the inward flange 21 of the shroud support element 17.

Figure 2:
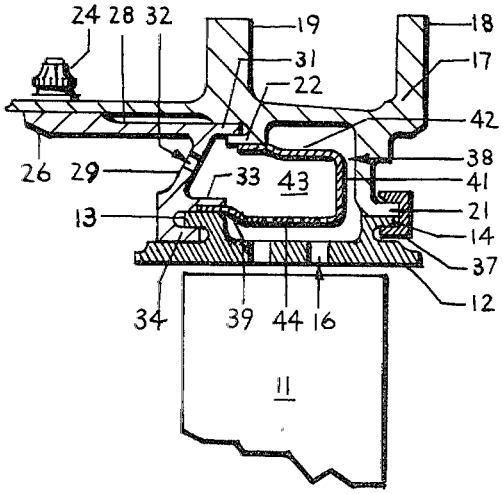
FIG. 2 is a longitudinal cross-sectional view thereof.

Also attached to and supported by the shroud support element 17 is an impingement baffle 38 which is substantially U-shaped in form and is comprised of legs 39, 41 and 42. The impingement baffle 38 is formed in a continuous ring and is sized such that when placed in the installed position as shown in FIGS. 1 and 2, the leg 42 fits tightly within the inner surface of the inward flange 22 and the leg 39 fits tightly within the inner surface of the rearward outer flange 33 of the support bracket 26. The impingement baffle may be secured in this position by way of spot welding or brazing or the like. In this way, a substantially leak-free plenum 43 is formed by the support bracket 26, the shroud support element 17 and the impingement baffle 28. This plenum is then fed with high-pressure bleed air from the compressor by way of the ports 32, which air passes through the plurality of perforations 44 in the impingement baffle leg 39 to impinge against the outer surface of the shroud 12 for cooling purposes. The legs 41 and 42 act to isolate the cooling air in the plenum 43 from the relatively warm shroud support element 17 disposed adjacent thereto.

When the high pressure air passes through the perforations 44 of the impingement baffle 38, there is a substantial pressure drop such that the impinged air is then at a relatively low pressure and will tend to flow out the holes 16. Some of this low pressure air may tend to flow along the leakage paths between the shroud segments or between the shroud and the shroud support elements. However, since this air has already been used for the efficient impingement cooling process, and since the air is now at a low pressure, such leakage will be of minimum consequence.

Figure 3:
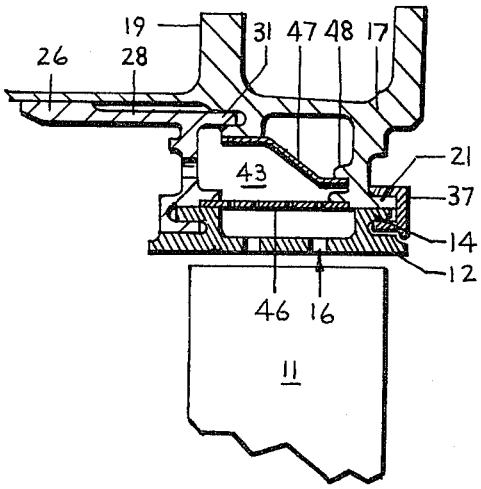
FIG. 3 is a longitudinal cross-sectional view of an alternate embodiment thereof.

Referring to FIG. 3, there is a modified embodiment shown wherein the impingement baffle 46 comprises a flat ring element which is attached at its forward end to the flange 33 of the support bracket 26 and, at its rearward end to the inward flange 21 of the shroud support element 17. Again, the impingement baffle is sized such that when placed in the installed position it forms an interference fit with those mating elements. It may be further secured by way of spot welding or the like.

The heat shield 47 is independent from the impingement baffle 46 and comprises a continuous ring whose one end tightly fits against the one surface of the inward flange 22 of the shroud support element 17 and, whose other end fits against the inner surface of a lip 48 formed on the shroud support element 17. Now the plenum 43 is formed by a combination of the support bracket 26, the shroud support element 17, the impingement baffle 46 and the heat shield 47 and functions in essentially the same way as described hereinabove to provide high pressure air to impinge against the shroud 12 with little leakage from the plenum 43.

It will be understood that while the present invention has been described in terms of preferred and modified embodiments, it may take on any number of other forms while remaining within the scope and intent of the invention.

Having thus described the invention, what is claimed as novel and desired to be secured by Letters Patent of the United States is:

1. An improved turbine blade shroud support apparatus of the type having a support structure partially defining a cooling air plenum and providing support for a plurality of segmented shrouds located radially inward thereof with the cooling air plenum including leakage paths for relatively high pressure cooling air therein to leak therefrom without cooling the shroud where one of said leakage paths is between adjacent ones of said segmented shrouds and a second one of said leakage paths is between said segmented shrouds and said support structure, wherein the improvement comprises:

a perforated impingement baffle attached to the support structure to define the remaining portion of the cooling air plenum and provide for the impingement of cooling air on the shroud wherein the cooling air plenum provided by the support structure and the perforated impingement baffle comprises a relatively high pressure plenum which is relatively free of said leakage paths such that relatively high pressure air passes through the perforated impingement baffle providing the impingement of cooling air on the shroud and wherein the relatively low pressure impinged air may then flow along said first and second leakage paths.

2. An improved shroud support apparatus as set forth in claim 1 wherein said impingement baffle is substantially round in shape.

3. An improved shroud support apparatus as set forth in claim 1 and said impingement baffle comprises a continuous 360° band.

4. An improved shroud support apparatus as set forth in claim 1 wherein said impingement baffle is attached to the support structure by way of a friction fit.

5. An improved shroud support apparatus as set forth in claim 1 wherein said impingement baffle is attached to a radially inner surface of the support structure.

6. An improved shroud support apparatus as set forth in claim 1 wherein said impingement baffle is attached to the support structure by way of brazing.

7. An improved shroud support apparatus as set forth in claim 1 wherein said impingement baffle is attached to the support structure by way of welding.

8. An improved shroud support apparatus as set forth in claim 1 wherein the shroud support structure includes a pair of spaced flanges and said impingement baffle is attached to said flanges.

9. An improved shroud support apparatus as set forth in claim 8 wherein said pair of spaced flanges are spaced axially.

10. An improved shroud support apparatus as set forth in claim 8 wherein said pair of flanges are spaced radially.

11. An improved shroud support apparatus as set forth in claim 1 wherein said impingement baffle includes a heat shield portion which extends between the perforated portion and the support structure.

12. An improved shroud support apparatus as set forth in claim 1 wherein said impingement baffle is substantially U-shaped in axial cross section and wherein the cooling air plenum is at least partially defined on three sides by said impingement baffle.

* * * * *